US008801878B1

(12) United States Patent
Johnson et al.

(10) Patent No.: US 8,801,878 B1
(45) Date of Patent: Aug. 12, 2014

(54) LEAD-FREE PYROTECHNIC AND PRIMARY EXPLOSIVE COMPOSITIONS CONTAINING METAL IODATES

(75) Inventors: Curtis E. Johnson, Ridgecrest, CA (US); Kelvin T. Higa, Ridgecrest, CA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 89 days.

(21) Appl. No.: 13/227,052

(22) Filed: Sep. 7, 2011

Related U.S. Application Data

(62) Division of application No. 11/779,247, filed on Jul. 17, 2007.

(51) Int. Cl.

| | |
|---|---|
| ***C06B 45/00*** | (2006.01) |
| ***C06B 45/02*** | (2006.01) |
| ***C06B 33/00*** | (2006.01) |
| ***C06B 33/06*** | (2006.01) |
| ***C06B 29/14*** | (2006.01) |
| ***D03D 23/00*** | (2006.01) |
| ***D03D 43/00*** | (2006.01) |

(52) U.S. Cl.
USPC ..... 149/42; 149/2; 149/21; 149/37; 149/81; 149/109.2

(58) Field of Classification Search
USPC ..... 149/42, 2, 21, 37, 81, 109.2
See application file for complete search history.

(56) References Cited

U.S. PATENT DOCUMENTS

| | | | | |
|---|---|---|---|---|
| 3,140,207 | A * | 7/1964 | Williams et al. | 149/19.8 |
| 3,667,231 | A | 6/1972 | Hubbuch et al. | |
| 3,698,968 | A | 10/1972 | Johnson et al. | |
| 3,788,908 | A | 1/1974 | Lehikoinen et al. | |
| 3,915,379 | A | 10/1975 | Burkardt et al. | |
| 3,945,202 | A | 3/1976 | Marion et al. | |
| 4,096,005 | A * | 6/1978 | Slusher | 149/18 |
| 5,266,132 | A | 11/1993 | Danen et al. | |
| 5,717,159 | A | 2/1998 | Dixon et al. | |
| 6,179,899 | B1 * | 1/2001 | Higa et al. | 75/722 |
| 6,663,731 | B1 | 12/2003 | Rose et al. | |
| 2003/0024617 | A1 * | 2/2003 | Reed et al. | 149/19.4 |
| 2003/0145758 | A1 | 8/2003 | Hofmann et al. | |

OTHER PUBLICATIONS

Dagani, R., Chem and Chem. Engineering New, 1999, p. 25-31, vol.
C.E. Johnson, et. al, "nanothermites with condensible gas products", Proc 35th International Pyrotechnics Seminar, Jul. 2008.
B.R. Clark et al, "The aluminum and iodine pentoxide reaction for the destruction of spore forming bacteria", Phys. Chem. Chem. Phys., Oct. 21, 2010, 12(39) 12653.
Grinshpun, eta l, "Inactivation of aerosolized *Bacillus atrophaeus* (BG) endospores and MS2 vruses by combustion of reactive materials," Environ. Sci. & Tech., 2012.

* cited by examiner

*Primary Examiner* — James McDonough
(74) *Attorney, Agent, or Firm* — Charlene A. Haley

(57) ABSTRACT

A lead-free pyrotechnic and primary explosive compositions including metal iodates as an oxidizer in nanocomposite energetic compositions including metal powder fuel.

10 Claims, No Drawings

LEAD-FREE PYROTECHNIC AND PRIMARY EXPLOSIVE COMPOSITIONS CONTAINING METAL IODATES

CROSS-REFERENCE TO RELATED APPLICATIONS

This is a divisional application, claiming the benefit of, parent application Ser. No. 11/779,247 filed on Jul. 17, 2007, whereby the entire disclosure of which is incorporated hereby reference.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

Embodiments of the invention relate to lead-free pyrotechnic and primary explosive compositions. More particularly, this invention relates to the use of metal iodates as an oxidizer in nanocomposite energetic compositions including metal powder fuel. Applications for the invention include electric and percussion primers.

BACKGROUND OF THE INVENTION

Most current cartridge type percussion and electrical primer ignited ammunition use lead (Pb) based primers that release toxic air-borne lead. The United States military services expend more than 20 million such rounds per year and each year non-military rounds expended are in the hundreds of millions. The conventional primer compositions for such ammunition are based on lead azide, lead styphnate, and barium nitrate [a) Olin MSDS No. 00061.001, http://www.winchester.com/pdf/MsdsPDF/msds_w61.pdf last accessed Jun. 15, 2007, b) "Combustion Products of Propellants and Ammunition", D. B. Kirchner, J. C. Gaydos, and M. C. Battigelli, http://bordeninstitute.army.mil/published_volumes/occ_health/OHch10.pdf last accessed Jun. 16, 2007].

Such conventional primer compositions require expensive handling procedures during both production and disposal. Several tons of these toxic materials and heavy metals are used annually by U.S. commercial suppliers in the production of percussion primer compositions. The Navy uses electric Gattling guns (20 mm and 25 mm) that fire hundreds of rounds per minute and subject Naval personnel to air-borne lead. Further, lead contamination of firing ranges (indoor and outdoor) costs the United States government millions of dollars a year in remediation costs. To reduce these costs, a joint effort between the government and industry is currently trying to develop less environmentally damaging ammunition for military applications.

The detrimental health effects of lead exposure in humans are well known [http://www.epa.gov/lead last accessed Jun. 16, 2007]. Lead exposure by inhalation or digestion can have serious health consequences such as heavy metal poisoning, nervous system disorders, kidney damage, and liver damage, for example. The adverse health effects may also include gastrointestinal, cardiovascular, renal, immunological and hematological disorders, and death. Environmental concerns about the hazards of lead exposure in the manufacturing process and during firing of small caliber ammunition in enclosed firing ranges have prompted ammunition manufacturers to develop lead-free primer alternatives, primarily based on diazodinitrophenol (DINOL) [Olin MSDS No. 00094.0001, http://www.winchester.com/pdf/MsdsPDF/msds_w94.pdf last accessed Jun. 16, 2007].

While the DINOL based lead-free primers are sold for commercial applications, such compositions have not met more stringent military requirements. For example, primer compositions used in military applications must function reliably at temperatures in the range of −65° F. to 165° F. However, the functional reliability of DINOL based primers decreases with decreasing temperature. The fact that externally mounted aircraft weapons are routinely subjected to severe cold conditions renders the low temperature performance of primer compositions extremely important, as weapon hang fire/misfire can have serious adverse consequences. While current DINOL primer compositions satisfy the requirements of ordinary commercial applications, such compositions do not function reliably at all temperatures between −65° F. and 165° F.

U.S. Pat. No. 5,266,132 issued on Nov. 30, 1993 to Danen, et al., which is assigned to the U.S. Government, teaches energetic nanoscale compositions, which consist of layers of two reactive substances, which are aluminum and cupric oxide, wherein the layers are formed by thin film deposition. In this composition each layer of aluminum is separated from at least one layer of cupric oxide by a buffer layer. However, the all-up round action times for the nanoscale metal-metal oxide formulations are much too long (50-500 milliseconds), as military requirements for DOD application are less than 4 milliseconds.

U.S. Pat. No. 5,717,159 issued on Feb. 10, 1998 to Dixon, et al., also assigned to the U.S. Government, teaches the use of nanoscale composites for percussion primer application. The U.S. Department of the Army developed and tested these metastable interstitial composite (MIC) primers, but found that the ignition delay was greater than 50 milliseconds, compared to less than 4 milliseconds for conventional lead-based primers. These MIC primer ignition delay times were not suitable for many military applications requiring high firing rates.

It is an object of the invention to provide improved primer compositions which do not contain toxic materials and whose by-products are essentially non-toxic and environmentally benign.

DETAILED DESCRIPTION OF THE INVENTION

An aspect of the invention generally relate to electrically activated primer composition including: metal particles having a mean size less than about 200 nanometers selected from the group of metals consisting of aluminum, magnesium, titanium, boron, silicon, and zirconium; metal-iodate particles having a mean size less than about 500 nanometers selected from the group of metal-iodates consisting of $AgIO_3$, $Bi(IO_3)_3$, $Cu(IO_3)_2$, $Zn(IO_3)_2$, $Mn(IO_3)_2$, $Sr(IO_3)_2$, $Ca(IO_3)_2$, $KIO_3$, and $NaIO_3$ present in approximately stoichiometric amount to react fully with said metal; and a sufficient amount of conductive material to enable ignition of the primer composition by ohmic heating.

Other aspects of the invention generally relate to percussion activated primer compositions including: metal particles having a mean size less than about 200 nanometers selected from the group of metals consisting of aluminum, magnesium, titanium, boron, silicon, and zirconium; metal-iodate particles having a mean size less than about 500 nanometers selected from the group of metal-iodates consisting of $AgIO_3$, $Bi(IO_3)_3$, $Cu(IO_3)_2$, $Zn(IO_3)_2$, $Mn(IO_3)_2$, $Sr(IO_3)_2$, $Ca(IO_3)_2$, $KIO_3$, and $NaIO_3$ present in approximately stoichiometric amount to react fully with said metal.

In some embodiments, an equivalence ratio of 1 refers to the stoichiometric composition of fuel and oxidizer and compositions may have an equivalence ratio in the range of about 0.5-3.0. Other embodiments further include at least one gas generating material and at least one binder material. In embodiments, the gas generating material is bis (aminotetrazolyl) tetrazine or (aminotetrazolyl) tetrazine. In other embodiments, the gas generating material is an energetic compound including nitrogen and oxygen.

In embodiments, the binder material is a halogenated elastomer or poly(ethylene glycol). In embodiments, the conductive material is selected from the group consisting of carbon, $CaSi_2$, and conductive polymer.

In general, the initiation and explosive properties of energetic materials are dramatically affected by their microstructures [Dagani, R., Chemical and Chemical Engineering News, 1999, 77, p. 25-31]. It is well known that many physical properties of energetic materials made of metastable interstitial composites, composed of nanoscale components or elements and commonly referred to as "nanocomposites," are enhanced or improved. Generally, the term "nanocomposite" means a multicomponent material in which at least one of the elements or component phases has one or more dimensions (length, width, or thickness) in the nanometer size range, usually defined as 1 nm to 100 nm. Metastable interstitial composites are also known as metastable nanoenergetic composites (MNC) or superthermites. These energetic materials ignite readily and react rapidly with high temperature output. Due to the large differences in reactivity and properties, MICs and other energetic nanocomposites are considered to be a different class of material compared to the corresponding micron-scale materials.

The present invention discloses a metal powder-metal iodate based energetic nanocomposite. The metal iodate functions as the oxidizer for a metal powder fuel in the compositions of the present invention. These nanoscale compositions appear to be particularly well suited for cartridge type percussion or electrical primer ignited ammunition. Pyrotechnic compositions containing metal fuels and metal iodates as oxidizers have been described previously, but not in the form of nanocomposites. Compositions containing silver iodate and aluminum or magnesium have been used to control weather by cloud seeding [a) Simpson, J., Woodley, W. L., Friedman, H. A., Slusher, T. W., Scheffee, R. S., Steele, R. L., "An Airborne Pyrotechnic Cloud Seeding System and Its Use", Journal of Applied Meteorology, 1970, 9, pp. 109-122. b) Burkardt, L. A., Finnegan, W. G., Odencrantz, F. K., St. Amand, P., Stanifer, C. D., U.S. Pat. No. 3,915,379, Oct. 28, 1975.]. Compositions containing lead or potassium iodate and metal fuels have been described for high density rocket propellants [Marion, F. A., McSpadden, H. J., U.S. Pat. No. 3,945,202, Mar. 23, 1976.]. Iodate salts and metal powders have been described for use in initiating liquid monopropellants for rocket propulsion [Hubbuch, T. N. Murfree, Jr., J. A., Duncan, W. A., Sandlin, B. J., Nappier, H. A., U.S. Pat. No. 3,667,231, Jun. 6, 1972.].

Metal iodates and metal fuels form highly energetic mixtures with metal fuels, that typically contain about twice the energy of lead azide or lead styphnate on a volume basis. Table 1 lists properties of selected metal fuel/$AgIO_3$ mixtures, along with some related materials and conventional primary explosive compounds. The metal/$AgIO_3$ mixtures offer very high reaction enthalpies and densities.

TABLE I

Density and reaction enthalpy of selected compositions.

| Reaction | d, g/cc | $-\Delta H_r$/cc, kJ/cc | $-\Delta H_r$/g, kJ/g |
|---|---|---|---|
| $Al + \frac{1}{2} AgIO_3 \rightarrow \frac{1}{2}A1_2O_3 + \frac{1}{2}AgI$ | 4.74 | 22.0 | 4.65 |
| $Ti + \frac{2}{3} AgIO_3 \rightarrow TiO_2 + \frac{2}{3} AgI$ | 5.29 | 19.4 | 3.66 |
| $Mg + \frac{1}{3} AgIO_3 \rightarrow MgO + \frac{1}{3}AgI$ | 3.82 | 18.2 | 4.77 |
| $Al + \frac{1}{2} Bi_2O_3 \rightarrow \frac{1}{2} Al_2O_3 + Bi$ | 7.19 | 15.2 | 2.12 |
| $Al + \frac{3}{10} I_2O_5 \rightarrow \frac{1}{2} Al_2O_3 + \frac{3}{10} I_2$ | 4.12 | 25.6 | 6.22 |
| $Al + \frac{1}{2} MoO_3 \rightarrow \frac{1}{2} Al_2O_3 + \frac{1}{2} Mo$ | 3.91 | 18.4 | 4.70 |
| $Pb(N_3)_2 \rightarrow Pb + 3 N_2$ | 4.71 | 7.8 | 1.66 |
| $PbC_6H_3N_3O_9$ (lead styphnate) $\rightarrow Pb + \frac{3}{2} N_2 + \frac{3}{2} H_2O + \frac{15}{4} CO_2 + \frac{9}{4} C$ | 3.05 | 9.6 | 3.15 |

Primer Material Preparation & Composition

The use of metal powders and oxidizers in nanocomposite primers has been known for a number of years (U.S. Pat. Nos. 5,266,132 and 5,717,159). The present invention relates to the use of a metal iodate as the oxidizer for a metal powder fuel in this type of nanocomposite. The metal iodate replaces the metal oxide or non-metal oxide described in prior art. The volatile reaction products produced by certain metal iodates (e.g., including iodine molecules and/or atoms) can improve primer performance in comparison to metal oxide oxidizers, such as molybdenum trioxide ($MoO_3$). Additional gas generating materials may also be added to the formulation to improve action times in primers.

A typical primer preparation scheme is described below:

Metal (35-100 nm) and oxidizer→add gas generator→add binder→add conductive additive Nanoscale metal powder (such as, for example, aluminum, magnesium, titanium, boron, silicon, or zirconium) is intimately mixed with a metal iodate oxidizer (such as, for example, $AgIO_3$, $Bi(IO_3)_3$, $Cu(IO_3)_2$, $Zn(IO_3)_2$, $Mn(IO_3)_2$, $Sr(IO_3)_2$, $Ca(IO_3)_2$, $KIO_3$, $NaIO_3$, or $M(IO_3)_x$ where M is a suitably active metal and x is equal to the absolute value of the valence of M). Methods for the intimate mixing of nanoscale metal powders are known in the art and include mixing in low-boiling-temperature solvents using ultrasonic devices, passivating the surface of reactive metal particles prior to mixing, and applying a protective coating to the surface of reactive metal particles prior to mixing. A gas generating material (such as a high nitrogen compound, bis (aminotetrazolyl) tetrazine (BTATZ), or (aminotetrazolyl) tetrazine (TATZ), for example) is thoroughly mixed with the metal-oxidizer nanocomposite, then the particles of the composite may be coated with a binder material (such as halogenated elastomers, Kel-F or poly(ethylene glycol), for example). For electrically activated primer applications, a conductive material (such as carbon, conductive polymer, or $CaSi_2$, for example) is added to the composite to enable ignition by ohmic heating.

In our work, nanoscale $AgIO_3$, $Bi(IO_3)_3$, and $Cu(IO_3)_2$ were prepared by modified procedures designed to produce nanocrystalline materials. Compositions of nanoscale $AgIO_3$, $Bi(IO_3)_3$, and $Cu(IO_3)_2$ with nanoscale aluminum powder were prepared and compared to compositions containing $MoO_3$, $Bi_2O_3$, and $I_2O_5$ as the oxidizer. Table II lists data on the particle size of the oxidizer and the sensitivity to electrostatic discharge (ESD) for the compositions.

TABLE II

Oxidizer particle size and ESD sensitivity data for selected compositions containing 80-nm Al.

| Oxidizer | BET particle size, nm | ESD sensitivity, mJ[a] | Water solubility and reactivity of oxidizer |
|---|---|---|---|
| $AgIO_3$ | 235 | 0.90 | $Km_{sp}$ $3 \times 10^{-8}$ |
| $AgIO_3$[b] | 895 | — | $K_{sp}$ $3 \times 10^{-8}$ |
| $Bi(IO_3)_3$ | 62 | 0.121 | practically insoluble, forms hydrate |
| $Cu(IO_3)_2 \cdot H_2O$ | 800 | 2.5 | $K_{sp}$ $7 \times 10^{-8}$, forms hydrate |
| $Bi_2O_3$ | 50 | <0.004 | practically insoluble |
| $Bi_2O_3$ | 320 | <0.004 | practically insoluble |
| $Bi_2O_3$ | 2500 | <0.004 | practically insoluble |
| $I_2O_5$[b] | 1690 | — | very soluble, forms $HIO_3$ |
| $MoO_3$ | 50 | 0.04 | 0.4 g/L, forms hydrate |

[a]Materials that initiate at 250 millijoules or higher are considered to be insensitive to electrostatic discharge (ESD).
[b]Particle size of commercial reagent was reduced by ball milling.

The properties of metal iodates may be varied by selecting different metal cations, some of which are listed here as examples: $AgIO_3$, $Bi(IO_3)_3$, $Cu(IO_3)_2$, $Zn(IO_3)_2$, $Mn(IO_3)_2$, $Sr(IO_3)_2$, $Ca(IO_3)_2$, $KIO_3$, and $NaIO_3$. For some primer applications insolubility in water and stability to water are desirable to allow for possible water loading of the primer, while reducing the likelihood of aging the nano metal powder. $AgIO_3$ oxidant is particularly preferred since it is essentially insoluble in water and does not tend to form hydrates.

The iodate compounds were prepared by precipitation using known procedures modified to promote the production of nano-sized particles as follows:

$AgIO_3$ was prepared by adding, at about 1 milliliter (mL) per second (sec), a solution of 6.02 g $AgNO_3$ in 25 mL water to a solution of 7.86 g $NaIO_3$ in 170 mL water with stirring. The precipitate was filtered and washed with water, ethanol, and ether, then dried in an oven for about 22 hours (h) at about 53° C. to give a 97.4% yield.

$Bi(IO_3)_3$ was prepared by rapidly adding a bismuth nitrate solution in 5% $HNO_3$ (vs. concentrated) to an $HIO_3$ solution. The precipitate was filtered and washed with water, ethanol, and ether, then dried for about 6 h at about 128° C. to dehydrate the product.

The following examples of compositions of metal iodates with nano-sized metal powders illustrate preferred embodiments of the present invention:

Example 1

A mixture containing 0.212 g of 80 nm aluminum powder and 0.788 g of 235 nm $AgIO_3$ powder in 30 mL of hexane was treated with a 400 Watt Branson Sonifier using 75% amplitude, 0.5 sec pulse and 0.5 sec delay for 2 minutes (min) of total pulse time. The product was filtered through filter paper and the resulting cake broken up into a fine powder using a grounded metal spatula. The product was transferred into a conductive polyethylene vial and dried under vacuum for 1 h.

Example 2

A mixture containing 0.227 g of 80 nm aluminum powder and 0.791 g of 895 nm $AgIO_3$ powder (prepared by ball milling commercial $AgIO_3$) were dry mixed in a polyethylene bottle by shaking for 1 min. The powder mixture was transferred into a polyethylene cup and 30 mL of hexane added to form a slurry. The slurry was sonicated and the product mixture isolated as described in Example 1.

Example 3

A slurry of 0.217 g of 62 nm $Bi(IO_3)_3$ in 20 mL of hexane was treated with a 100 Watt GE Ultrasonic Processor at 100% amplitude, 0.5 sec pulse on, 0.5 sec pulse delay for 3 min. 0.071 g of 80 nm aluminum powder was added to the slurry and the resultant slurry was sonicated and the product mixture isolated as described in Example 1.

Example 4

A solid mixture of 0.297 g of 80 nm aluminum powder and 0.728 g of 800 nm $Cu(IO_3)_2.H_2O$ powder was dry mixed for 1 min by shaking in a 100 mL polyethylene bottle. The mixture was transferred into a 30 mL polyethylene cup, 25 mL of hexane was added, and the resultant slurry was sonicated and the product mixture isolated as described in Example 1.

A preferred embodiment of the present invention for applications such as primers involves the combination of nanoscale aluminum with nanoscale silver iodate. The silver iodate has several desirable properties that can make it superior to other oxidizers, such as $MoO_3$, $Bi_2O_3$, and $I_2O_5$. Silver iodate is insensitive to water, while $MoO_3$ and $I_2O_5$ are not compatible with water loading processes ($I_2O_5$ reacts readily with water, forming iodic acid, which may necessitate addition of an acid-neutralizing stabilizer, as described in U.S. Pat. No. 6,663,731). Silver iodate mixtures with nanoscale aluminum are less sensitive to ESD than the corresponding mixtures with $MoO_3$ and $Bi_2O_3$ (see Table II). Silver iodate mixtures with aluminum provide higher energy densities than the corresponding mixtures with $MoO_3$ and $Bi_2O_3$ (see Table I). Silver iodate can be easily produced as a nanoscale powder by a simple precipitation process.

An electric primer composition containing 80-nm aluminum and 235-nm $AgIO_3$ was tested for performance in an all-up round, and compared to the standard M52A3B 1 composition containing lead styphnate, and a composition containing $MoO_3$. The results in Table III show that these primers all meet the 4 ms action time requirement, and that the silver iodate composition exhibits excellent low temperature performance.

TABLE III

Primer compositions and action times for all-up round tests.

| Composition | Action time at ambient, ms | Action time at −65° F., ms |
|---|---|---|
| 29.4% Al + 42.1% $MoO_3$ + 25% gas generant + 1.4% Kel-F + 2% C | 3.19 ± 0.13 | 3.54 ± 0.15 |
| 15% Al + 56% $AgIO_3$ + 25% gas generant + 2% Kel-F + 2% C | 2.98 ± 0.15 | 3.01 ± 0.02 |
| M52A3B1 | 2.75 | 3.01 |

In addition to percussion and electrical primer applications, the metal fuel—metal iodate mixtures can be useful for a variety of other pyrotechnic and energetic material applications, such as training grenades, flash-bang grenades, cartridge actuated devices (CADs), propellant actuated devices (PADs), flares, and fireworks including indoor fireworks.

While the present invention has been described in connection with what are currently considered to be the most practical and preferred embodiments, it is to be understood that the invention is not to be limited to the disclosed embodiments, but to the contrary, is intended to cover various modifications, embodiments, and equivalent processes included within the spirit of the invention as may be suggested by the teachings herein, which are set forth in the appended claims, and which scope is to be accorded the broadest interpretation so as to encompass all such modifications, embodiments, and equivalent processes.

What is claimed is:

1. An electrically activated primer composition, comprising:

metal particles having a mean size less than about 200 nanometers selected from the group of metals consisting of aluminum, magnesium, titanium, boron, silicon, and zirconium;

metal-iodate particles having a mean size less than about 500 nanometers selected from the group of metal-iodates consisting of $AgIO_3$, $Bi(IO_3)_3$, $Cu(IO_3)_2$, $Zn(IO_3)_2$, $Mn(IO_3)_2$, $Sr(IO_3)_2$, $Ca(IO_3)_2$, $KIO_3$, and $NaIO_3$ present in approximately stoichiometric amount to react fully with said metal; and a sufficient amount of conductive material to enable ignition of the primer composition by ohmic heating.

2. The composition of claim 1, further comprising a gas generating material;

a binder material.

3. The composition of claim 2, wherein said gas generating material is bis (aminotetrazolyl) tetrazine or (aminotetrazolyl) tetrazine.

4. The composition of claim 2, wherein said gas generating material is an energetic compound including nitrogen and oxygen.

5. The composition of claim 2, wherein said binder material is a halogenated elastomer or poly(ethylene glycol).

6. A percussion activated primer composition, consisting of:

metal particles having a mean size less than about 200 nanometers selected from the group of metals consisting of aluminum, magnesium, titanium, boron, silicon, and zirconium;

metal-iodate particles having a mean size less than about 500 nanometers selected from the group of metal-iodates consisting of $AgIO_3$, $Bi(IO_3)_3$, $Cu(IO_3)_2$, $Zn(IO_3)_2$, $Mn(IO_3)_2$, $Sr(IO_3)_2$, $Ca(IO_3)_2$, $KIO_3$, and $NaIO_3$ present in approximately stoichiometric amount to react fully with said metal; a gas generating material, comprising a nitrogen containing organic fuel; and a binder material.

7. The composition of claim 1, wherein said conductive material is selected from the group consisting of carbon, $CaSi_2$, and conductive polymer.

8. The composition of claim 6, wherein said gas generating material is bis (aminotetrazolyl) tetrazine or (aminotetrazolyl) tetrazine.

9. The composition of claim 6, wherein said gas generating material is an energetic compound containing nitrogen and oxygen.

10. The composition of claim 6, wherein said binder material is a halogenated elastomer or poly(ethylene glycol).

* * * * *